United States Patent [19]

Taylor

[11] 4,450,691

[45] May 29, 1984

[54] FROST DETECTING DEVICE

[75] Inventor: John H. Taylor, Lachine, Canada

[73] Assignee: Dectron Inc., Montreal, Canada

[21] Appl. No.: 435,286

[22] Filed: Oct. 19, 1982

[51] Int. Cl.[3] ..... F25D 21/02; H01J 5/02

[52] U.S. Cl. ..... 62/140; 250/239; 340/583

[58] Field of Search ..... 62/128, 126, 140, 151; 250/341, 215, 239; 340/601, 602, 583

[56] References Cited

U.S. PATENT DOCUMENTS

| | | | |
|---|---|---|---|
| 3,961,495 | 6/1976 | Beauvent et al. | 62/140 |
| 4,021,119 | 5/1977 | Stauffer | 250/239 |
| 4,176,524 | 12/1979 | Kamiyama et al. | 62/140 |
| 4,232,528 | 11/1980 | Behr | 62/140 |

FOREIGN PATENT DOCUMENTS

| | | | |
|---|---|---|---|
| 2641600 | 3/1978 | Fed. Rep. of Germany | 62/140 |
| 54-40346 | 3/1979 | Japan | 62/151 |

*Primary Examiner*—Albert J. Makay
*Assistant Examiner*—Harry Tanner
*Attorney, Agent, or Firm*—Larson and Taylor

[57] ABSTRACT

A frost detecting device for a refrigeration unit of the type having refrigeration coils and fins. The device is adapted to be mounted on the side of the unit with frost accumulating means projecting from the unit to contact at least one fin in a manner to accumulate frost thereon at about the same rate as the fin. The device carries means for detecting a predetermined amount of frost on the accumulating means, in order to activate a defrosting cycle.

7 Claims, 8 Drawing Figures

FROST DETECTING DEVICE

This is a continuation of the application Ser. No. 192,615 filed Sept. 30, 1980, now abandoned.

This invention is directed toward an improved frost detecting device.

The invention is particularly directed toward an improved frost detecting device of the type used in refrigeration units having cooling coils equipped with fins.

Frost detecting devices of the above type are known as shown in U.S. Pat. No. 3,961,495 issued June 8, 1976. These devices are mounted on the refrigerating unit to detect a predetermined build-up of frost on the fins of the unit. An initial frost build-up on the fins is acceptable since the efficiency of the refrigeration unit at this time is the greatest. With a frost build-up over a predetermined thickness however, the efficiency of the unit is reduced since the heat transfer capabilities of the fins are reduced. When the device detects a frost build-up above an acceptable thickness level, it initiates a defrosting cycle to eliminate the frost.

The known detecting device has a radiation source to emit radiation through a passage formed in one of the fins, and detecting means to detect the radiation passing through the passage. When frost builds up on the fins to an unacceptable thickness, the passage in the one fin is closed by the frost and the radiation can no longer be detected. This non-detecting condition can then be used to initiate a defrost cycle.

In theory, the known device shown in the above mentioned patent should work well. In practice however, several problems are encountered. For the device to operate properly, some of the fins in the refrigerating unit must be cut in a particular manner to receive the device, and one fin must be quite accurately cut to provide the control passage. This cutting operation is a difficult job and special cutting tools may be necessary. In addition, the actual mounting of the device within the fins is quite difficult.

Locating the device within the fins of the refrigerating unit also presents problems. Dirt accumulates on the fins and coils of the refrigeration unit and during a defrost cycle, this dirt is carried down by run-off water over the detecting device. The dirt may adversely affect the operation of the device if it is deposited in the control passage and/or on the radiation emitting or detecting units.

It is the purpose of the present invention to provide an improved frost detecting device which avoids, or at least minimizes, the problems encountered in using known devices.

In accordance with the present invention, the improved detecting device is provided with frost accumulating means having its own built-in, control passage. This eliminates having to cut or form the fins of the refrigeration unit to provide the control passage. In addition, the improved detecting device is constructed to be simply mounted on the side of the refrigeration unit rather than within it thus making it much more simple to mount, and thus also minimizing any problems arising from having any dirt washed over the device during defrosting. In addition, the main operating components in the improved device are well protected from dirt accumulation or inadvertant physical damage.

In a preferred embodiment of the invention, the improved detecting device is constructed so that when it is mounted on the side of a refrigerating unit, air, circulated by the fan of the refrigeration unit, can flow first directly over the control passage on the frost accumulating means, and then over the fins of the refrigerating unit. This arrangement permits the frost to build up on the control passage first and be detected therein before it builds up to an unacceptable level on the refrigeration unit.

In addition, the flow of air directly over the control passage or slot, and also over the radiation emitting and detecting units, keeps them relatively dust free and clean.

The invention is particularly directed toward a frost detecting device having a support and frost accumulating means on the support. Means are provided for mounting the device on the side of a refrigerating unit having fins with the frost accumulating means in close contact with at least one fin to accumulate frost thereon at approximately the same rate as the frost accumulates on the fin. Means are provided on the device for detecting a predetermined amount of frost on the accumulating means.

The frost detecting means comprises a radiation emitting unit and a radiation detecting unit mounted on the support with the frost accumulating means mounted on the support between them. Passage means are provided in the frost accumulating means for normally passing radiation between the radiation emitting and detecting units.

The support preferably comprises a tubular member with the frost accumulating means, including the passage means therein, mounted within the member. A portion of the frost accumulating means projects out from one end of the member.

The invention will now be described in detail having reference to the accompanying drawings in which.

Figure 1:
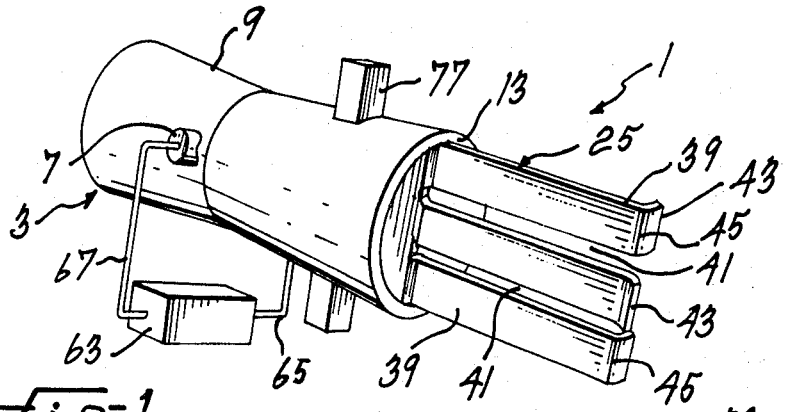
FIG. 1 is a perspective view of the frost detecting device.

The frost detecting device 1 of the present invention, shown in FIGS. 1 to 4, has a support 3 carrying radiation emitting and detecting units 5, 7. The support 3, in the embodiment shown, is in the form of a tubular member 9. The radiation emitting and detecting units 5, 7 are mounted in the wall 11 of the tubular member intermediate its ends 13, 15. The units 5, 7 are located on an axis 17 which is perpendicular to the longitudinal axis 19 of the member 9, and are diametrically opposed to each other with a gap 21 between them within the tubular member 9.

Frost accumulating means 25 are mounted on support 3. The frost accumulating means 25 comprises a generally rectangular-shaped plate member 27. The plate member 27 has a width substantially the same as the inner diameter of tubular member 9. One end of the plate 27 is adapted to be mounted within the tube 9, through its rear end 13. The leading end edge 29 of plate 27 extends just past the radiation units 5, 7, within the tube, the plate 27 being centrally located in gap 21. The plate 27 is fixed along a portion of its side edges 31 to the inside of tube wall 11 by welding 33 or other means such as a suitable groove in tube wall 11.

Means are provided for attaching the device 1 to the fins 35 of a refrigerating unit. These means can comprise clamping strips 39 formed in the portion of the plate 27 which projects out from the rear end 13 of tube 9. Three strips 39 can be formed by cutting a pair of longitudinal slots 41 into the plate 27 from its rear end edge 43. The ends 45 of adjacent strips are bent slightly in opposite directions.

The plate 27 is preferably made from the same material as that used in the fins 35 so that the plate accumulates frost thereon at about the same rate as the fins accumulate frost. The device 1 is attached to a single fin 35*a* by sliding it onto the fin with the fin 35*a* interleaved between the clamping strips 39. The strips 39 are made large enough to provide a good area of thermal contact between the strips and the fin so that frost accumulates at about the same rate on the plate 27 as on the fins 35. The strips 39 tightly clamp onto the fin 35*a* to hold the device 1 in place. If needed however, means (not shown) can be provided to detachably fasten the device 1 to the pipes 47 of the refrigerating unit to hold the device in place.

Passage means 51 are provided in the frost accumulating means 27 for passing radiation between the radiation units 5, 7. The passage means 51 can comprise a narrow rectangular-shaped slot 53 extending longitudinally inwardly from the leading end edge 29 of plate 27. The plate 27 is positioned to have the slot 53 located between the units 5, 7 to normally permit the passage of radiation between them. The slot 53 can have a width ranging from between one and three thirty seconds of an inch. This width range has been found to produce the best frost detecting results. If the slot is narrower, the refrigeration unit is defrosted too quickly for efficient operation. If the slot is wider the unit is defrosted too slowly.

Preferably each long side edge 55 of the slot 53 is joined to the leading end edge 29 of the plate 27 by a relatively short angled edge 57 at the mouth 59 of the slot. These angled edges, each of which preferably extends at an angle of 45° to the respective side edge 55 of the slot, facilitate flow of moisture away from the slot when defrosting it as will be described.

In operation, the device 1 is mounted on the side of the refrigeration unit 37 by sliding the clamping strips 39 over a fin 35*a*. The device 1 is mounted so that the open end 15 of tube 9 faces the flowing air, shown by arrow 61, directed by the fan of the refrigeration unit over the fins 35 and coils 47. The radiation emitting and detecting units 5, 7 are then activated by a control unit 63 connected to units 5, 7 by leads 65, 67 respectively. Radiation is emitted by emitter unit 5 and passes through slot 53 on the frost accumulating means 25 to be detected by the detecting unit 7. The radiation can be infra-red, white, or coloured visible light radiation.

As the refrigeration unit operates, and air flows first through the tube 9 and then over the fins, frost builds up on the fins 35 and also on the plate 27 which connects to fin 35*a* with its strips 39. Eventually the frost builds up thick enough to start to reduce the efficiency of the unit while at the same time building up in slot 53 and eventually closing it. When slot 53 is closed with frost, this prevents the radiation from being detected by detector unit 7 and control unit 63 is thus alerted to the fact that frost is about to build up on the refrigeration unit to an unacceptable level. Since the plate 27 is in advance of the fins 35 in the air flow, the frost will build up to an unacceptable level in slot 53 before it will on fins 35.

The control unit 63 will now automatically initiate a defrost cycle in the refrigeration unit to eliminate the frost. The slot 53, adjacent the fins 35, will be the last area defrosted thus ensuring complete defrosting of the refrigeration unit before a refrigeration cycle is again initiated.

Figure 2:
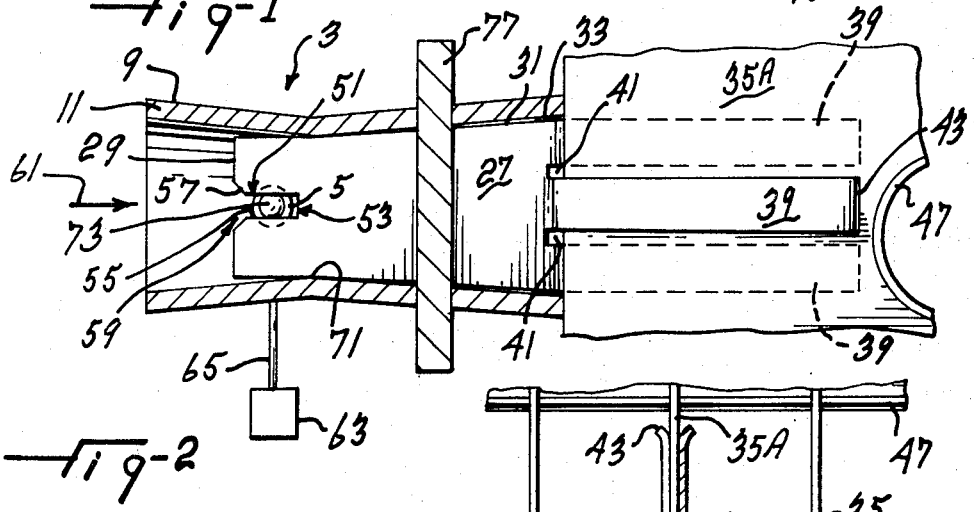
FIG. 2 is a longitudinal cross-section view of the device, taken along line 2—2 of FIG. 3, with the device mounted on a refrigeration unit.
Figure 3:
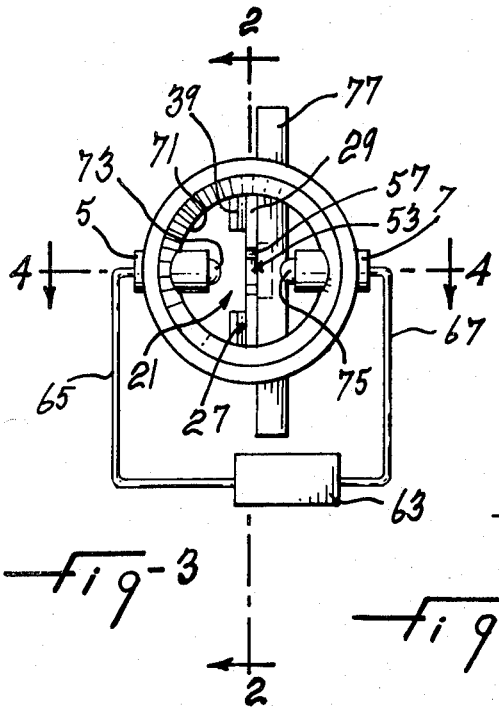
FIG. 3 is an end elevation view of the device.
Figure 4:
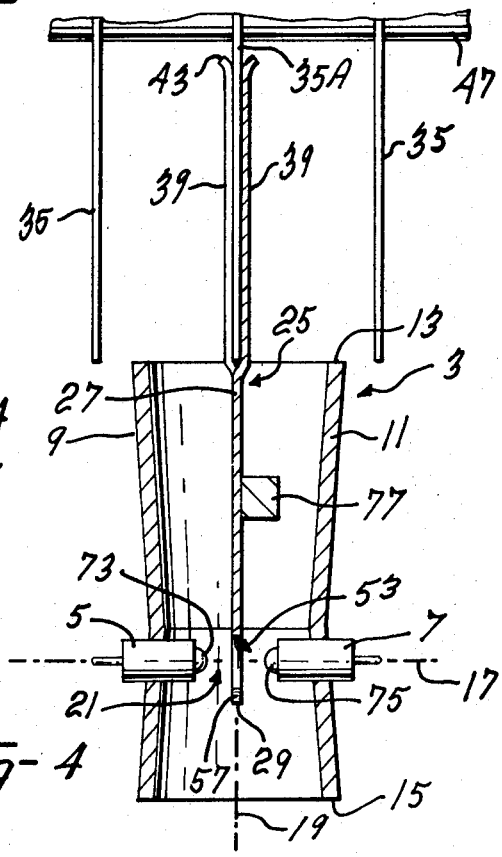
FIG. 4 is a cross-section view of the device taken along line 4—4 of FIG. 3.

In a preferred embodiment of the invention, the interior surface of the support tube 9 can have a necked-down portion 71 between its ends 13, 15 as shown in FIG. 2. This necked-down portion 71 is located in the vicinity of the radiation units 5, 7 and is shaped to provide a venturi effect in the interior of tube 9. The air flow normally through tube 9, from the refrigeration fan, is at the rate of around 500'/min. This flow rate may not be fast enough to keep the exposed faces 73, 75 of the radiation units 5, 7 respectively, free of dust. Shaping the interior of the tube 9 to a venturi increases the rate of air flow past the units 5, 7 so that less dust accumulates on them. The side edges 31 of the plate 27 within tube can be shaped to fit the tapered interior of the tube rearwardly of the necked-down portion 71.

The device 1 may be provided with a metal, temperature detecting bar 77. The bar 77 has a square cross-section and is fixed to one surface of plate 27. The bar 77 extends perpendicularly to the plate 27 and projects through the wall 11 of the tube 9. The ends of bar 77 are connected to a temperature sensing device (not shown) in control unit 63 by suitable leads. The bar 77 is used to control the end of defrosting and can also be used to delay operation of the refrigerator fan. When the defrosting is finished, and the refrigeration unit begins operation, the fan operation is delayed until the fins are cold. If the fan is turned on too early the moisture from the melting frost will be carried into the space being refrigerated which is not desirable. Delaying fan operation gives time for the residual moisture on the fins to freeze. The bar 77 can also be as a high temperature alarm to indicate that the refrigeration unit is not operating satisfactorily.

Figure 5:
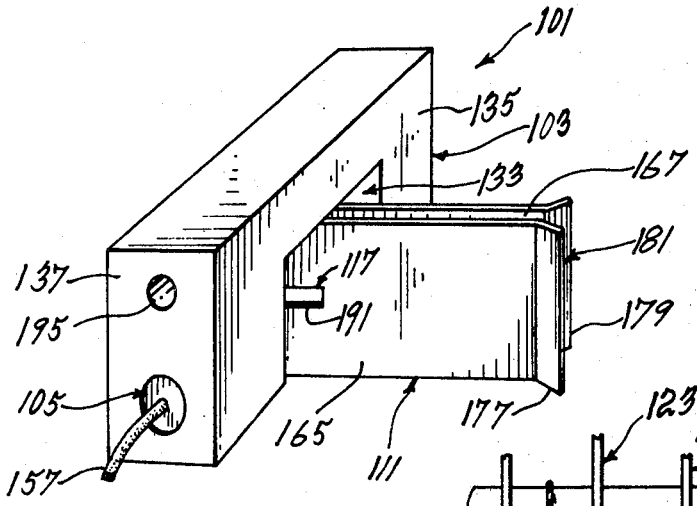
FIG. 5 is a perspective view of another embodiment of the frost detecting device.
Figure 6:
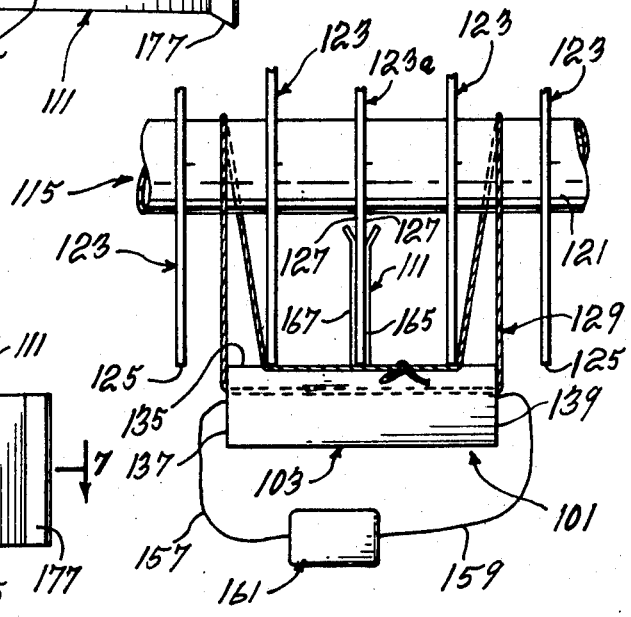
FIG. 6 is a partial plan view showing the device of FIG. 5 mounted on a refrigeration unit.
Figure 8:
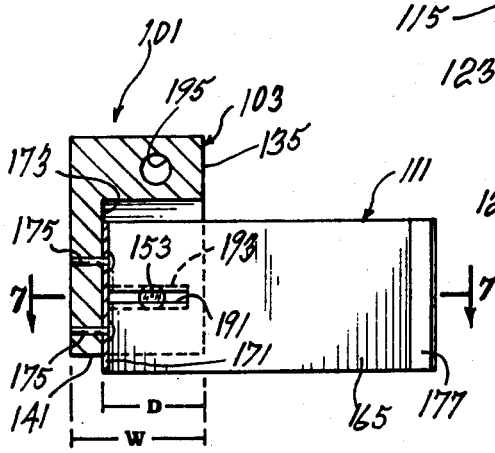
FIG. 8 is a cross-section view of the device taken along line 8—8 of FIG. 7
Figure 7:
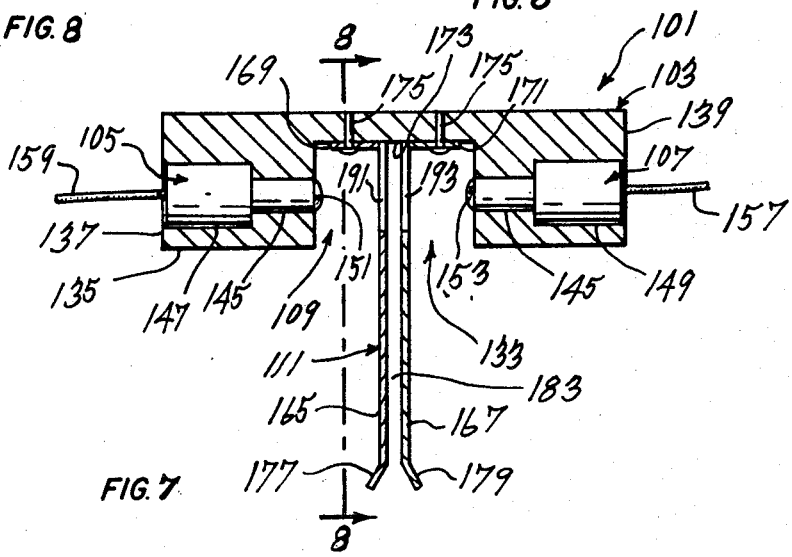
FIG. 7 is a cross-section view of the device taken along line 7—7 of FIG. 8.

While a preferred embodiment of the frost detecting device 1 has been described, it can take other forms as well. As shown in FIGS. 5 to 8 the frost detecting device 101 in another embodiment is similar to the device described above in that it has a support 103 carrying radiation emitting and detecting units 105, 107 respectively as shown in FIGS. 5 and 7. A gap 109 is provided between the units 105, 107 in support 103. Frost accumulating means 111, are mounted on the support with a portion within the gap 109. The frost accumulating means 111 projects from the support and makes tight surface contact with the fins of a refrigeration unit 115 as shown in FIG. 6. Passage means 117 are provided in the frost accumulating means 111, in the gap area 109, which passage means are aligned with the radiation emitting and detecting units 105, 107. The passage means 117 normally permits passage of radiation between units 105, 107.

The refrigeration unit 115 as shown in FIG. 6 is of a standard construction as before, employing refrigerant carrying coils 121 mounted in a set of parallel, spaced-apart cooling fins 123. The detecting device 101, as before, is adapted to be mounted against the side of the unit 115. In this embodiment however, the support 103 is placed across some of the fins 123, against their edges 125. The frost accumulating means 111 is still however positioned against the side surface or surfaces 127 of one of the fins 123*a*. Means are provided for fastening the detection device 101 to the refrigeration unit 115 in this position. The fastening means can comprise a flexible member 129, such as cord or strap, tying the device 101 to the coils 121.

In more detail, the support 103 of the frost detecting device 101 can comprise a rectangular-shaped block having a rectangular-shaped recess 133 formed in one wide side 135 of the block. The recess 133 is preferably centrally located in side 135 between the ends 137, 139 of the block and extends into the adjacent narrow, bottom side 141 of the block. The recess 133 has a depth "d", inwardly from side 135, equal to about three-quarters the width "w" of the support 103.

A mounting bore 145 extends through the support 103 between its ends 137, 139. The bore 145 is interrupted by the recess 133. The ends 147, 149 of the bore 145, adjacent support ends 137, 139, respectively can be counterbored, if required. The mounting bore 145 receives the radiation emitting and detecting units 105, 107 to mount them in the support 103. Emitting unit 105 is mounted in one end 147 of bore 145 with its emitting end 151 just projecting into recess 133. Detecting unit 107 is mounted in the other end 149 of bore 145 with its detecting end 153 just projecting into recess 133 opposite emitting end 151. Electrical leads 157, 159 extend from units 105, 107 respectively to a control device 161 which controls their operation.

The frost accumulating means 111 preferably comprise a pair of parallel, slightly spaced-apart, rectangular plate members 165, 167. These plate members 165, 167 are also preferably made of the same material as the refrigeration fins 123 so that frost will accumulate on the plates at about the same rate as on the fins. One end of each plate member 165, 167 is bent at a right angle to form a fastening flange 169, 171 respectively. The plate members 165, 167 are fastened, at the flanges 169, 171, to the back wall 173 of recess 133 by screws 175 or other suitable fastening means, with the plate members 165, 167 extending perpendicular to the bore 145. The outer ends of the plates members 165, 167 can be bent outwardly to form angled flanges 177, 179 respectively forming a wide inlet 181 to the narrow gap 183 defined between the plates. The gap 183 has a width substantially equal to, and preferably just slightly less than, the width of the fins 123.

The device 101 is mounted on the refrigeration unit 115 by sliding one of the fins 123*a* into gap 183 and moving the support 103 inwardly until its side wall 135 abuts the edges 125 of the fins 123. The width of gap 183 is such that the plate members 165, 167 make good surface contact with the sides of fin 123*a*. The area of contact between the plate members 165, 167 and the fin 123*a* should be such as to ensure good thermal contact. The plate members 165, 167 can be slightly springy to tightly grip the fin.

The passage means 117 in the frost accumulating means 111 can comprise a first narrow, rectangular, control slot 191 in one plate member 165, and a second, wider rectangular slot 193 aligned with slot 191, in the second plate member 167. The slots 191, 193 are centered with respect to the axis of bore 145 and normally pass radiation from emitting unit 105 to detecting unit 107. The control slot 191 has a width ranging between one and three thirty-seconds of an inch.

In operation, the detecting device 101 is mounted on the refrigeration unit 115 by sliding one fin 123*a* into the gap 183 between plates 165, 167. The support 103 is fastened tightly against the edges of fins 123 by flexible fastening member 129. The flexible member 129 can be threaded through a bore 195 in support 103 which bore 195 extends parallel to bore 145 between ends 137, 139. The bore 195 passes above recess 133. After being threaded through bore 195, the member 129 is tied about the refrigeration coils 121. The radiation emitting and detecting units 105, 107 are then activated by control 161.

As the refrigeration unit operates, frost builds up on the fins 23 and plates 165, 167. The build-up of frost gradually narrows, and finally closes, control slot 191 in strip 165. This prevents the radiation, emitted from unit 105, from being detected by detector unit 107 and this condition alerts control 161 that frost has built up to an unacceptable level. The control device 161 may now automatically initiate a defrost cycle in the refrigeration unit to eliminate the frost. Alternatively, the control device 161 may operate a separate heater positioned to direct hot air over the refrigeration unit to eliminate the frost. If a separate heater is used, suitable timing or temperature sensing means can be incorporated in the control 161 to ensure complete defrosting before initiating a refrigeration cycle. Suitable safety means, such as a timer, or temperature sensor, can be provided on control 161 to ensure the refrigeration unit will be turned on, even if defrosting is not completed, to protect the goods being refrigerated.

By mounting the radiation emitting and detecting units, and the control slot, in both embodiments outside of the fins, they are not affected by dirty, run-off water present during defrosting. In addition, the radiation units, and control slot, mounted within the tube 9 or within the recess 133 are protected from any physical abuse. It will also be seen that no modification of the refrigeration unit is necessary to install the improved detector device.

The embodiments of the invention in which an exclusive property or privilege is claimed are defined as follows:

1. A frost detecting device having:

a mounting block, the mounting block having one side face which is meant to be mounted against the edges of a plurality of refrigeration fins;

a recess in the mounting block between its ends, the recess extending inwardly into the mounting block from the one side face and located below the top face of the mounting block;

frost accumulating means fixed to the mounting block within the recess and projecting transversely outwardly from the recess past the one side face of the mounting block for surface contact with one of the refrigerator fins;

a radiation emitting means mounted in the mounting block on one side of the recess; radiation detecting means mounted in the mounting block on the other side of the recess opposite the radiation emitting means;

and passage means in that portion of the frost accumulating means within the recess for normally passing radiation between the radiation emitting and detecting means.

2. A device as claimed in claim 1 wherein the frost accumulating means comprise a pair of parallel plates, spaced apart to tightly receive a fin of the refrigerating unit therebetween.

3. A device as claimed in claim 2 wherein the passage means comprise a first narrow rectangular slot in one plate aligned with the radiation emitting and detecting means, and a second, wider rectangular slot in the other plate, centered with respect to the first slot.

4. A device as claimed in claim 3 wherein the support is provided with a recess therein, the portions of the plates having the slots mounted within the recess.

5. A device as claimed in claim 3 wherein the first slot has a width ranging between one and three-thirty seconds of an inch.

6. A frost detecting device as claimed in claim 1 wherein the mounting block has rectangular cross-section and a length sufficient to extend across at least three successive fins.

7. A frost detecting device as claimed in claim 1 including a bore through the block between its ends and above the recess for use in fastening the block tight against the fins.

* * * * *